US006923131B2

(12) United States Patent
Petrovich

(10) Patent No.: US 6,923,131 B2
(45) Date of Patent: Aug. 2, 2005

(54) WINDSURFING CATAMARAN WITH DYNAMIC SHOCK DAMPENED RIG CENTERING KEEL AND HULL SUPPORT

(76) Inventor: Enrique Petrovich, 1149 Hillsborough Mile, Apt 412N, Hillsborough Beach, FL (US) 33062

( * ) Notice: Subject to any disclaimer, the term of this patent is extended or adjusted under 35 U.S.C. 154(b) by 0 days.

(21) Appl. No.: 10/279,666

(22) Filed: Oct. 23, 2002

(65) Prior Publication Data

US 2004/0079266 A1 Apr. 29, 2004

(51) Int. Cl.[7] ..... B63H 9/00; B63B 1/10

(52) U.S. Cl. ..... 114/39.26; 114/39.11; 114/61.1; 114/91; 114/136; 114/143

(58) Field of Search ..... 114/91, 39.11, 114/39.21, 39.26, 39.28, 39.32, 61.1, 61.14, 61.15, 61.16, 61.22, 61.23, 126, 127, 130–137, 140, 143, 364

(56) References Cited

U.S. PATENT DOCUMENTS

| | | | | | |
|---|---|---|---|---|---|
| 861,894 | A | * | 7/1907 | Pool | 114/91 |
| 996,444 | A | * | 6/1911 | Yarrington | 114/61.22 |
| 2,952,234 | A | * | 9/1960 | Levinson | 114/266 |
| 3,326,166 | A | * | 6/1967 | Yost | 114/283 |
| 3,401,663 | A | * | 9/1968 | Yost | 114/283 |
| 3,885,512 | A | * | 5/1975 | Marcil | 114/39.26 |
| 4,337,715 | A | * | 7/1982 | de Pingon | 114/121 |
| 4,610,212 | A | * | 9/1986 | Petrovich | 114/39.26 |
| 4,716,847 | A | * | 1/1988 | Wilson, Jr. | 114/61.15 |
| 5,072,682 | A | * | 12/1991 | Rodriguez Urroz et al. | 114/91 |
| 5,228,404 | A | * | 7/1993 | Gibbs | 114/61.16 |
| 5,410,977 | A | * | 5/1995 | Webb | 114/91 |
| 5,603,277 | A | * | 2/1997 | Webb | 114/39.25 |
| 6,789,489 | B1 | * | 9/2004 | Phipps | 114/39.24 |

FOREIGN PATENT DOCUMENTS

| | | | | |
|---|---|---|---|---|
| DE | 3318638 | A1 * | 11/1984 | B63B/1/14 |
| GB | 2187152 | A * | 9/1987 | B63B/39/00 |
| JP | 56013272 | A * | 2/1981 | B63B/1/12 |
| JP | 56028094 | A * | 3/1981 | B63H/9/00 |
| JP | 02109766 | A * | 4/1990 | B60V/1/08 |
| JP | 03213486 | A * | 9/1991 | B63B/1/18 |
| NL | 7801749 | A * | 8/1979 | B63B/41/00 |
| WO | WO 8103311 | A * | 11/1981 | B63B/1/14 |

* cited by examiner

*Primary Examiner*—S. Joseph Morano
*Assistant Examiner*—Ajay Vasudeva
(74) *Attorney, Agent, or Firm*—John C. Smith

(57) ABSTRACT

A windsurfing catamaran with a self-stabilizing wing. The wing is moved to the correct position by counter balancing water pressure from a rotating central keel connected to a central mast. The keel rotates in the opposite direction of the wing when the wing is moved off center by wind. The keel rotates such that a greater surface area is presented to water flow striking the keel. Water pressure on the keel offsets wind pressure on the sails and returns the keel and mast back to an upright position. This increases stability, lift, driving force, and speed. A central catamaran platform provides hinged struts and shock absorbers between the rear end of the central platform and planing hulls to reduce impact damage. The hinged struts and shock absorbers reduce water drag and the braking effect of repeated hull impacts with water resulting in a further increase in speed.

7 Claims, 10 Drawing Sheets

WINDSURFING CATAMARAN WITH DYNAMIC SHOCK DAMPENED RIG CENTERING KEEL AND HULL SUPPORT

BACKGROUND OF THE INVENTION

1. Technical Field

The present invention relates to sailing vessels. In particular, it relates to a dynamic shock dampened rig centering keel and hull support mechanism for sailing windsurfing catamarans that automatically corrects for shifts in mast orientation due to wind changes. It further relates to a rig apparatus that remains stable while allowing independent unstayed hull movement over wave surfaces.

2. Background Art

Windsurfing is a well-established and popular sporting activity that is enjoyed in many locations worldwide. The sport began by loosely attaching a pivoting mast and sail onto a conventional surfboard. This simple structure proved so enjoyable that it quickly became a widespread activity in beach areas worldwide. Originally, windsurfers were relatively small devices that used small sails that are easily manipulated by an individual through direct physical force. The structure provides several advantages including the proportionally highest sailing speeds, simplicity of design, and relatively low cost. They also have some disadvantages. In particular, windsurfing requires a certain amount of skill to be done properly, it requires a fair amount of physical strength and agility, and it also requires that the sailor have a substantial amount of endurance due to the high level of physical activity associated with the sport. It further requires the sailor to stand on the unstable floating board, while lifting and supporting the mast, boom and sail and positioning the sail favorably against the wind. It would be desirable to have a windsurfing device which can be used by sailors having lower skill levels, and which can be used for extended periods of time by sailors having ordinary physical strength and endurance characteristics.

One attempt to overcome the disadvantages associated with the original surfboard-based windsurfing device has been the development of larger, more complex windsurfing devices such as windsurfing catamarans. Prior art windsurfing catamarans have addressed some of the problems associated with windsurfers, but have made some of the problems more difficult. For example, prior art windsurfing catamarans improve upon a conventional windsurfer in the sense that they can support a larger sail assembly so they can potentially go faster than a conventional surfboard-based windsurfer. In addition, like conventional catamarans, prior art windsurfing catamarans have a higher degree of hull stability as compared to a windsurfer and are more difficult to capsize due to their dual parallel hulls. As a result, these windsurfing catamarans do not require the agility and skill on the part of the sailor that is necessary to stand on an unstable hull and maintain the windsurfing sail in a stable upright position as on a windsurfer.

While prior art windsurfing catamarans provide several advantages over a conventional windsurfer, they also have several drawbacks. In particular, to reach the same speed as a windsurfer, the sail on these catamarans must be substantially larger than the sail on a windsurfer to compensate for the added weight of their hulls and deck areas. While a standing sailor can control the relatively small sail on a windsurfer, the level of energy generated by a larger sail on such windsurfing catamarans is too strong for sailors to control through direct physical force. As a result, there is a substantial amount of difficulty presented to a sailor when some changes in wind direction and/or wind strength occur. Likewise, the catamaran structure is larger and its direction on the surface of the water cannot be easily controlled through physical force applied to the sail by the standing sailor unless a larger sail is not used, which automatically eliminates any relative speed advantage over a windsurfer.

In the case of a windsurfer, the unstable planing hull automatically adapts to wave oscillations. High-speed wave impact damage to the board, sail rig and sailor is prevented by free hull movement facilitated by a rubber universal joint at the base of the mast. This universal joint acts like a hinged strut allowing independent movement of hull and sail. The sailor stands on the windsurfer with bent knees that act as shock absorbers. By using his legs in this manner, a windsurfer sailor is able to maintain the hull position independent of the sail such that the hull remains in proper contact with the surface of the water. The unstable board conforms to the wave surfaces, while the sail rig and sailor's upper body remain in a relatively stable position oriented to the wind direction for maximum speed. Small windsurfing catamarans with no mechanical rig support are larger and heavier than windsurfers and too unresponsive for an individual sailor to control as effectively as a windsurfer in the required standing position, physically supporting the loose windsurfing wing. As a result, these windsurfing catamarans are slower than windsurfers. Their lower speeds and softer wave impacts cause no damage to the hulls, rig or sailors so they need little or no shock absorption.

A mechanical sailing rig support can allow a planing windsurfing catamaran to carry a large enough sail to reach high speeds while freeing the sailor from the physical requirements of standing, supporting and controlling a larger wing. However, for a windsurfing catamaran with a mechanical rig support to safely reach and surpass high windsurfer speeds in waves, hinged strut support and shock absorption of the rig, deck, hulls and sailor(s) are needed as much as on a windsurfer. Further, mechanical means must maintain the wing in a favorable position in relation to the wind direction while the hulls travel rapidly over bumpy waves, like the chassis of a car as the wheels travel at high speeds over rough terrain. And like a windsurfer, the windsurfing catamaran must be kept from capsizing by eliminating heeling.

Hull instability and rig stability are important on windsurfers and on all mechanical rig supported windsurfing catamarans. If the sail rig is fixed or stayed to the hulls in order to stabilize one in relation to the other, several disadvantages occur. First, the rapid acceleration and deceleration of the hulls at higher speeds, caused by the increased inertia and momentum of a fixed rig, will result in the rigid craft being constantly pounded by waves. This may cause structural damage to the hull, sail rig and sailor, as often happens on standard racing sailboats with fixed rigs. Second, the rapid impacts on the rigid hull will brake the forward motion of the craft through the water and result in loss of speed. Third, the bucking hulls would transmit this motion to the sailing rig, repeatedly changing the ideal orientation of the sail to the wind, reducing sail efficiency and lowering the speed over the waves. The rigid craft will then slog through the waves like conventional sailboats instead of its hulls independently adapting to the wave surfaces and riding smoothly over them like a windsurfer.

On a mechanical rig supported catamaran, it would be desirable to have an automatic method of controlling hull and rig position such that the hulls maintain proper contact with the surface water and the sail rig stays upright and oriented to the wind without being fixed to the bucking hulls. This will eliminate the disadvantages associated with sail rigs rigidly fixed to hulls and also eliminate the heeling or capsizing force to the windsurfing catamaran.

While providing a variety of catamaran types, the prior art has failed to provide a capsize resistant, high speed windsurfing catamaran with a shock damping hull and sail assembly capable of dynamic self correction during wind changes and further capable of supporting and protecting the rig, hulls and sailor(s) from impact damage while maintaining independent contact of the hulls with wave surfaces.

SUMMARY OF THE INVENTION

The present invention solves the foregoing problems, and greatly increases the speed, capsize resistance and ease of operation of a windsurfing catamaran. It does so by adding a swiveling and rotating central keel to the shock dampened, strut supported mast and hull structure. This central keel swivels in the opposite direction of the mast and winged sail structure of the catamaran while rotating to expose its side to the onrushing water flow. The force of the onrushing water moves the keel back to a stable position. As a result, the keel and sail are automatically restored to a horizontal and stable position.

As the mast and wing are moved off center by the wind, the keel swings in the opposite direction, also rotating on its axis. A greater surface area of the keel is thereby presented to the water flow that approaches the keel from the direction the catamaran heads toward, guided by dagger-boards and rudders on each hull. The force of the water on the keel offsets the force of the wind against the sail and automatically pushes the mast structure back towards a stable upright position. By pushing the mast structure toward a stable upright position, the stability of the sail rig is increased. Further, by pushing the winged sail structure of the catamaran back toward the wind, there is an increase in lift and in the speed of the catamaran.

In addition, the central platform in the catamaran provides hinged struts and shock absorbers between the rear end of the central platform and the planing hulls. These hinged struts and shock absorbers are analogous in function to the universal joint and sailor's knees on windsurfers. They support and cushion the hulls, rig and sailor(s) on the deck to prevent impact damage at high speeds. They also keep the wing in the correct orientation to the wind by not allowing the bucking hull motion to be transferred to the wing. The hinged struts and shock absorbers allow the hulls to move independently and adapt to wave surfaces instead of plowing through them. This also reduces impact damage to the hulls, which at windsurfing speeds will cause hull failure or other damage. Further, by maintaining the hull surfaces in proper relationship with the wave surfaces and independent of wing position, hinged struts and shock absorbers reduce water drag and the braking effect of repeated hull impacts with water. This results in an increase in catamaran speed while giving the sailor a smooth ride.

DESCRIPTION OF THE PREFERRED EMBODIMENT

Figure 1:
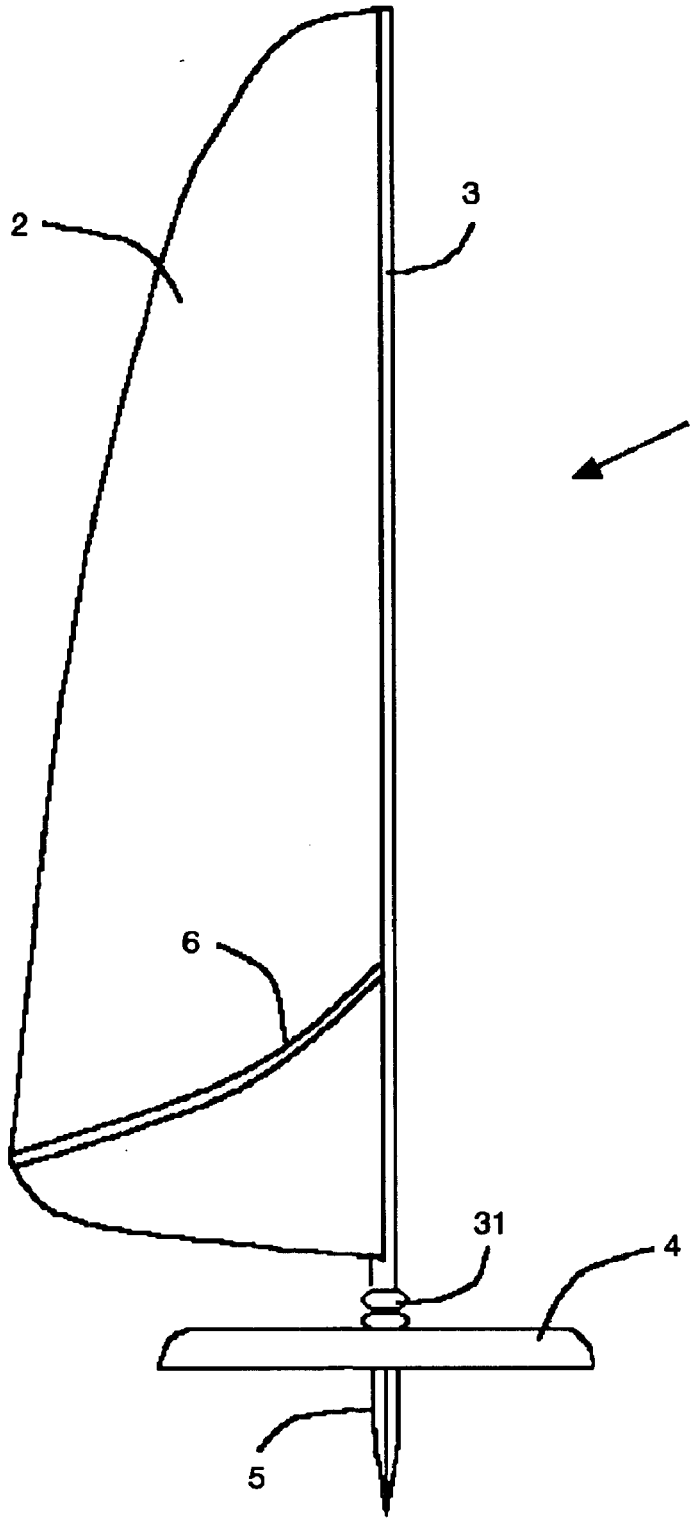
Figure 1 Prior Art
FIG. 1 is a rear view of a prior art wind surfer with a single sail.

Prior to a detailed discussion of the figures, a general overview of the invention will be presented. Windsurfing is a popular sport. Prior art windsurfers have been able to achieve the highest rates of sailing speeds for several reasons. One reason is that the sail on a windsurfer is canted toward the wind. This provides two main benefits: first, the wind provides direct driving force to move the wind surfer forward, and second, when the sail is in the proper position, the wind provides lift which reduces water drag by pulling the hull in an upward direction. As a result, proper canting of the sail produces lift, simultaneously reducing drag and increasing driving force, which results in improved speed.

A second factor that affects performance is the impact between the windsurfer hull and water surface. Typically, waves on the surface will impact the planing hull eventually causing it to bounce violently. This causes two problems. First, this type of motion and the force from the impacts will have the effect of destabilizing the orientation of the windsurfer and reducing its speed. Second, the constant impact of the water will eventually affect the structural soundness of the rig and hull and may result in their failure.

In the windsurfer, both of the foregoing factors are addressed. The first is addressed by the sailor riding on the windsurfer. Proper positioning of the sail is directly controlled by the sailor who physically moves the sail from one side to the other and into the most favorable wind. This allows precise human control over stable sail position in relation to the unstable hull. The second factor is supporting the sail and hull and absorbing the shock of wave impacts to the hull so it adapts to the wave surfaces and the sail rig is protected from such violent motion. This factor is controlled by a universal joint at the base of the mast where it joins the deck that acts as a hinged strut allowing the hull and sail to move independently. It is also controlled by the use of the sailor's legs as shock absorbers so that the unstable hull of the windsurfer can oscillate freely to adapt to wave surfaces while the sail rig and the upper body of the sailor remain stable.

A windsurfing catamaran would be easier for a sailor to stand on than a windsurfer due to its more stable deck. However, with a larger sail, large windsurfing catamarans would be subject to substantial forces from wind changes that would overpower an ordinary individual. Likewise, the wing and twin hulls of such catamarans are typically too large, too heavy, and too far apart to control by the physical efforts of a sailor. Therefore if they are to work and perform like a windsurfer, the simple techniques available to a small windsurfer will not work on larger windsurfing catamarans that are heavier and subject to greater forces.

The present invention solves the problem of maintaining a larger rig upright without sailor support, allowing even large windsurfing catamarans to work like windsurfers by providing a winged sail assembly with a counter-balancing keel attached to it. The keel was designed such that when the mast and sail are in a central forward facing position, the keel is also aligned in a central forward facing position. However, in the event of shift in the wind, the wind will push the winged sail and mast assembly to one side or another. When this happens the keel moves in the opposite direction and is rotated such that its broad flat surface sets at angles to the direction of the forward movement of the catamaran. This causes flowing water to impact the side of the keel and force the keel back towards the central forward facing position. The keel rotates while it swings from a pivot point and is attached to the mast and winged sail assembly so the mast and sail assembly have a counteracting force supplied by the keel which forces it to return to the central forward facing position.

Since water is much denser than air, it can supply substantially more force per square inch than moving air. As a result, the keel can be much smaller in surface area than the winged sail assembly and still provide a substantial amount of force to move the winged sail assembly back to its central forward facing position.

This new structure provides several benefits not heretofore found in windsurfing catamarans. In particular, by maintaining the mast and wing sail assembly upright without stays or shrouds, there is no torque imparted to the hulls from rig supports and the catamaran cannot heel. It is left in a more stable physical configuration that is less prone to capsizing. Maintaining the winged sail assembly in the proper position also provides the benefit that the winged sail assembly receives the greatest amount of useful energy from the wind as it receives both maximum lift and maximum forward driving force. As a result, the centering keel improves overall performance of the catamaran by providing both increased stability to the sail assembly and increased speed. Of particular importance is that control of the winged sail assembly is enhanced without requiring any physical exertion or requiring any skill by the sailor.

Another improvement to stability of the sail assembly is the use of hinged struts and shock absorbers between the rear portion of the central deck of the catamaran and the rear portions of the catamaran hulls. These provide mechanical support and cushion the rig for stability, while allowing the hulls the necessary instability to adapt to wave surface oscillations. This way, the bucking hulls do not transmit violent wave oscillations to the sail assembly so the sail assembly remains oriented in the most favorable wind direction. The hinged struts and shock absorbers on one hull act independently of those on the other hull. They simultaneously provide the mechanical rig support and the shock absorbing benefits that are provided by the universal joint and sailor's knees on a conventional windsurfer. Since each shock absorber acts independently, each hull reacts dynamically to wave conditions such that both hulls adjust to wave conditions under that particular hull like the hull of a windsurfer.

The combination of the counter balancing, counter rotating centering keel and the hinged struts and shock absorbers act to protect and maintain the sail assembly upright and in proper orientation to the wind, and the hulls in proper orientation to the water surface. As a result, a catamaran using these features will maintain greater stability where it is needed on the deck and sail assembly, and greater instability on the hulls where it is needed for greater speeds with a comfortable ride over rough water, as on a windsurfer. Having discussed the features of the invention in general, we turn now to a more detailed description of the figures.

FIG. 1 illustrates a rear view of a prior art windsurfer 1 with a single sail 2. The sail 2 in this device is secured to a windsurfer mast 3 that is in turn secured to a hull 4. The hull 4 has a rudder 5 extending from its lower surface to provide directional stability to the windsurfer 1 as it moves through water. Also shown in this figure is a control bar 6 secured to opposing sides of the sail 2 and a rubber universal joint 31. When a sailor is using the wind surfer 1, the sailor controls movement of the sail 2 manually by grasping the control bar 6 and using physical force to move it. In addition, the sailor will also move from one side of the sail 2 to the other side and grasp a second control bar 6 (not shown) that allows the sailor to use his weight to control the orientation and position of the sail 2. Of course, this requires substantial levels of skill and strength on the part of the sailor to properly control the sail 2. Other factors that enhance the performance of a conventional windsurfer 1 are the loosely attached windsurfer mast 3 by rubber universal joint 31 and the shock absorbing effect on movement of the hull 4 through the use of the sailor's knees acting as shock absorbers. It should be noted that while the rubber universal joint 31 provides for some independent movement of the mast 3 and the hull 4, it does not provide active control of the hull in relation to the wave surface. In particular, as the distance between the rubber universal joint 31 and particular locations on the hull 4 increases, the movement of the hull 4 becomes more substantial in relation to the mast 3. It is for this reason that a skilled sailor will use the sailor's legs as shock absorbers to control hull 4 position in relation to the surface of the water. As was the case with control of the sail 2, control of hull 4 movement also requires both skill and strength on the part of the sailor. Those skilled in the art will recognize that in the case of larger vessels, such as larger and heavier windsurfing catamarans with larger sails, the skill and strength of a standing sailor is insufficient to control the sail and hulls.

Figure 2:
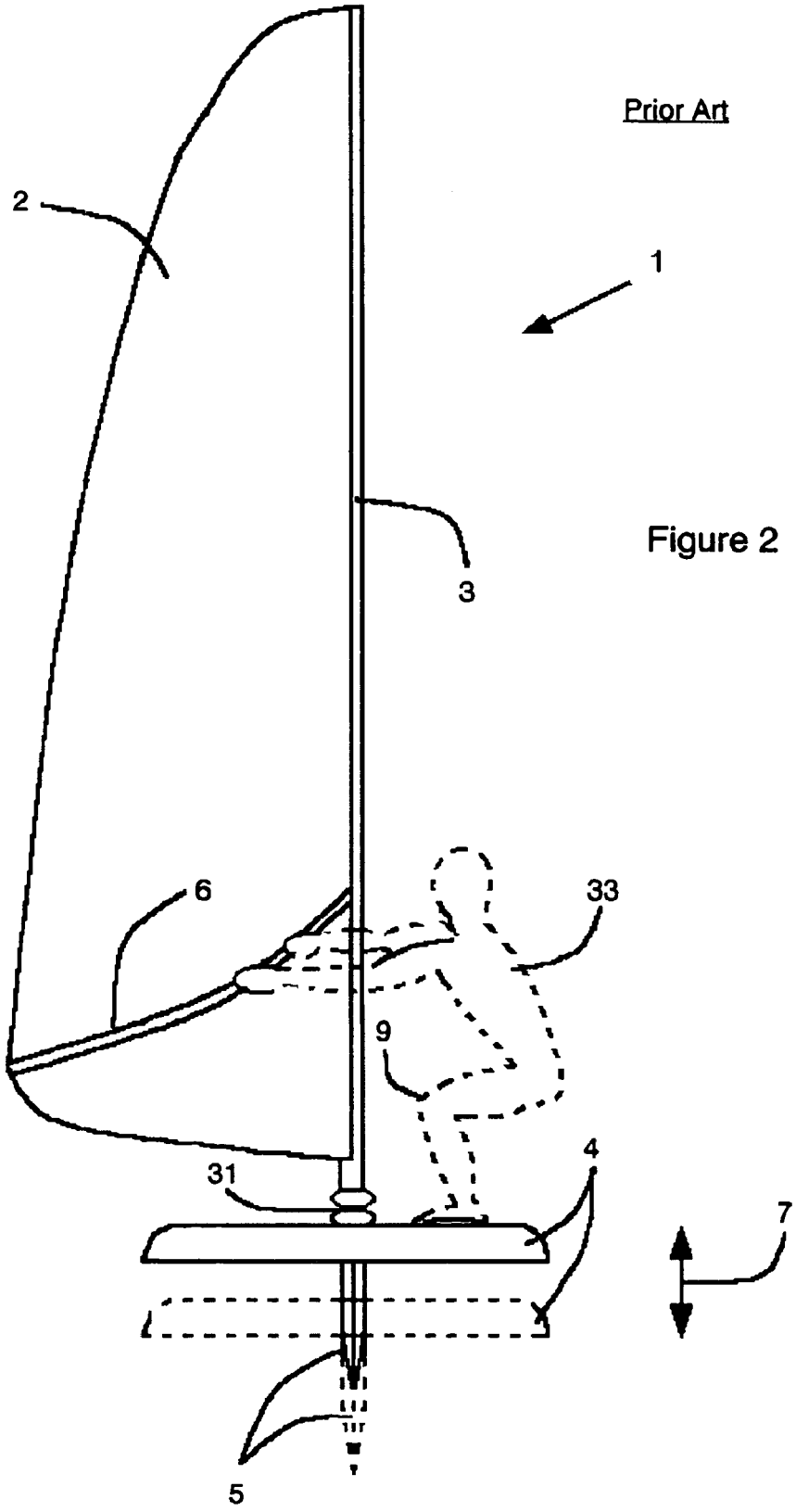
FIG. 2 is a rear view of a prior art windsurfer that illustrates the oscillating effect produced when the hull adapts to the surface of the waves. A sailor is also shown in this figure, absorbing the oscillation shocks with bent knees.

FIG. 2 is a rear view of a prior art wind surfer 1 that illustrates the oscillating effect produced when the unstable hull 4 adapts to the surface of the waves. When moving through water, the effect of the impact with waves on the bow and the stern causes the hull 4 to move up and down in opposing directions as indicated by directional arrows 7.

This decreases drag because the hull 4 does not plow through the waves, but rides over them without slowing the windsurfer 1. It also illustrates the sailor 33 absorbing the shocks of the oscillations using his bent knees as shock absorbers 9. In the absence of the sailor's skill in using his legs, there would be nothing to control stability of the hull 4 as it bounced against waves.

Figure 3:
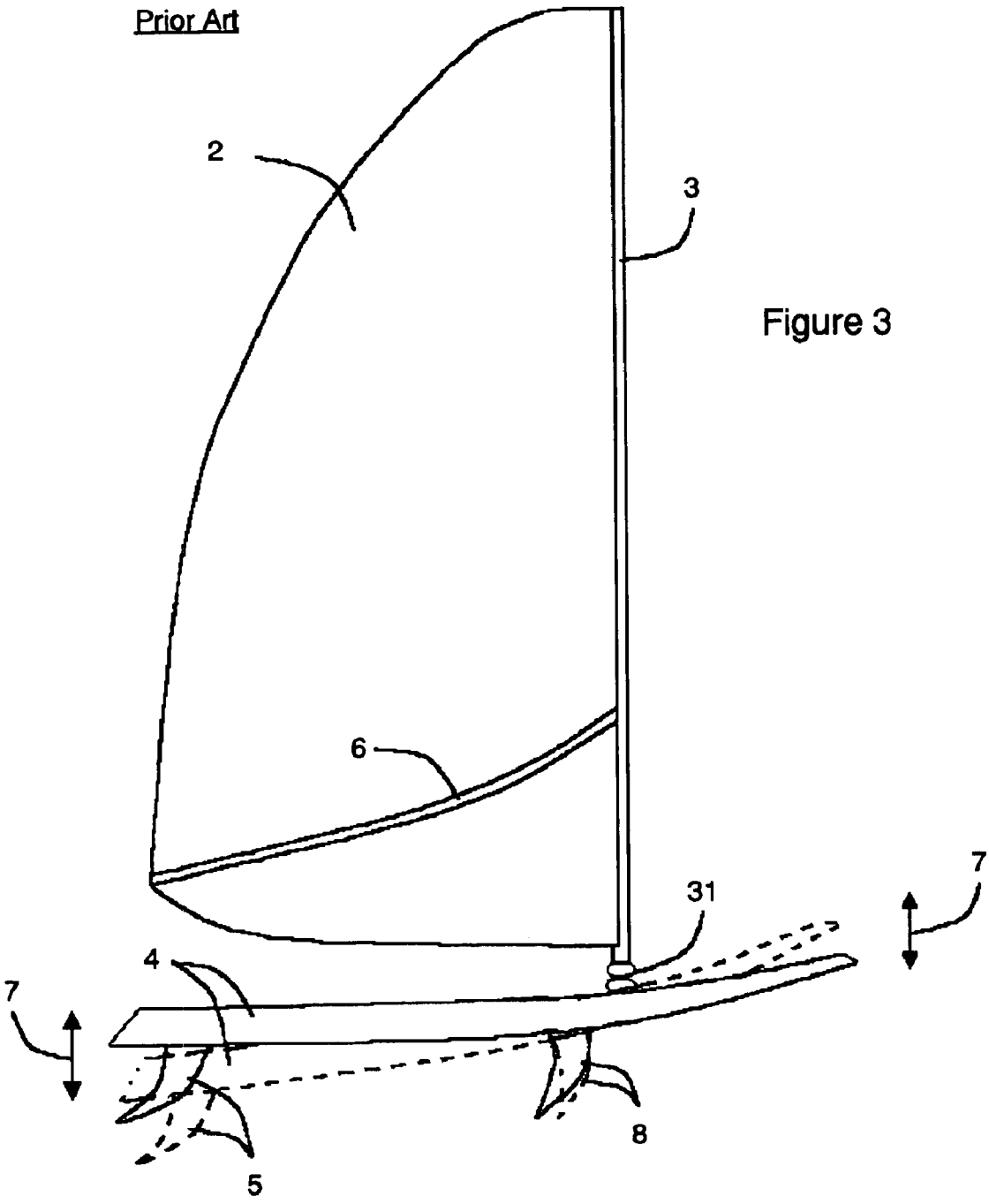
FIG. 3 is a side view of a prior art windsurfer that illustrates how the unstable hull oscillates on the waves in relation to the stable sail. It also shows the universal joint acting as a hinged strut to allow independent movement between hull and sail.

FIG. 3 is a side view of a prior art windsurfer 1 that illustrates the oscillating effect produced when the unstable hull 4 adapts to the surface of the waves independently of the stable sail 2 hinged to the hull 4 by universal joint 31. If the sail 2 and windsurfer mast 3 were stayed or otherwise fixed to the hull 4, the torque applied to the hull 4 by wind driven sail 2 would not allow the bow and stern of the hull 4 to adapt to, and to oscillate vertically over each wave as indicated by arrows 7. This would cause substantial wave impact and increased drag on the hull 4, which in turn would reduce speed as happens on conventional sailboats. Also shown in this figure are the dagger-boards 8 that like the rudder 5 add directional control and reduce the tendency of the windsurfer to rotate in the water.

Figure 4:
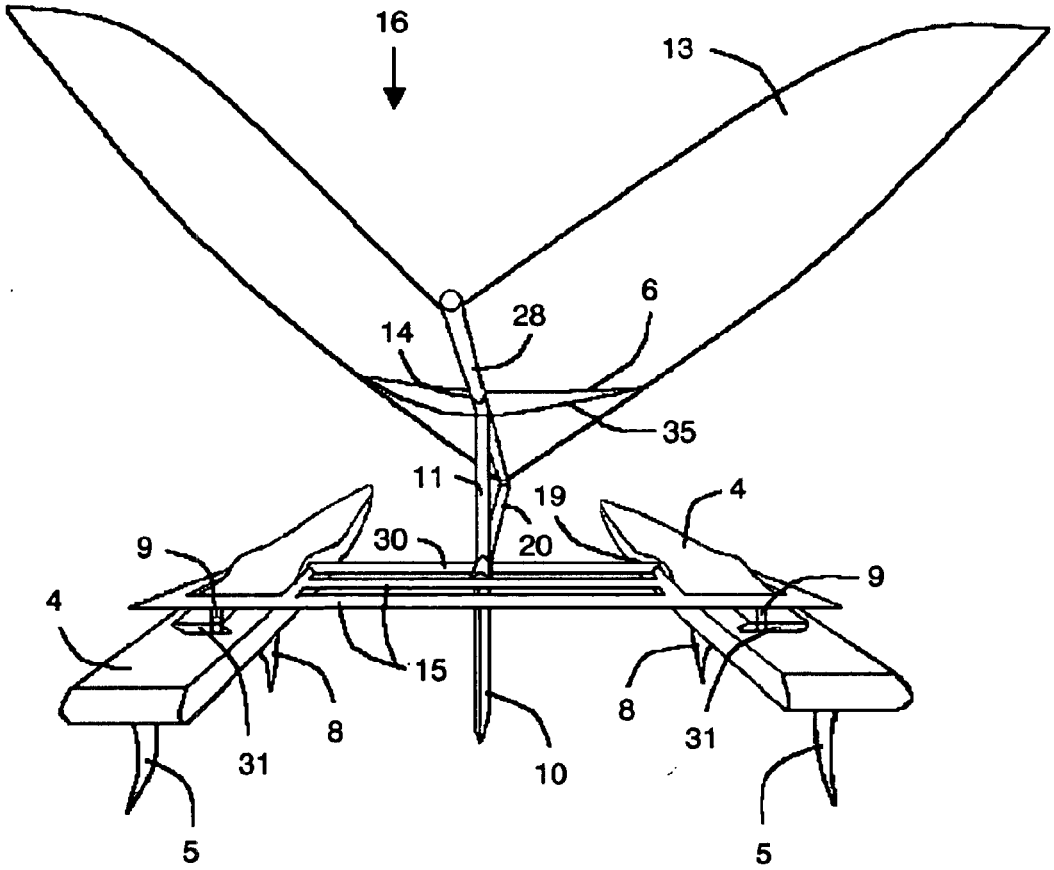
FIG. 4 is a rear perspective view of a preferred embodiment of the catamaran in the stable position with a delta wing sail. This figure illustrates the unstayed swinging rig mechanism attached to a counter rotating centering keel to offset movement of the catamaran wings due to changes in wind direction. Rig stabilizing hinged struts and shock absorbers are also illustrated.

FIG. 4 is a rear perspective view of a preferred embodiment of the windsurfing catamaran 16 with the wind direction aft. It illustrates the unstayed, free swinging, shock dampened, rig centering mechanism that uses a counter rotating centering keel 10 to offset movement of the attached mast 11 and delta wing 13 due to changes in wind direction. Stabilizing struts 31 and shock absorbers 9 are also illustrated. In this embodiment, two substantially parallel hulls 4 are secured together via the crossbeam 30 and its attached central deck assembly 15. The catamaran's delta wing 13 configuration shown is designed to tilt both longitudinally and laterally to take advantage of wind conditions. This wing 13 rotates laterally about a pivot point 14 on the mast 11 to center spar 28 of the wing 13. The centering keel 10 swings and rotates from the mast support bar 20 in the opposite direction to the mast 11. As will be discussed more fully below, rotation of the centering keel 10 orients the side surface of the keel 10 into the oncoming water flow which applies pressure to move the keel 10 back into the central position where it provides minimum resistance to the oncoming water, righting the mast 11, center spar 28 and wing 13. Sail control line 35 controls the attitude of the wing 13.

Also shown in this figure are shock absorbers 9 and hinged struts 31. The shock absorbers 9 and hinged struts 31 associated with a particular hull 4 act independently of the other hull 4 to cushion and support the rig and deck assembly 15. They allow the bow and stern portions of the hulls 4 to move dynamically and independently in response to wave conditions such that the bow and stern portions of the hulls 4 conform to the water surface. This reduces the pounding and plowing of hulls 4 through the waves created in the absence of the shock absorbers 9 and hinged struts 31.

Figure 5:
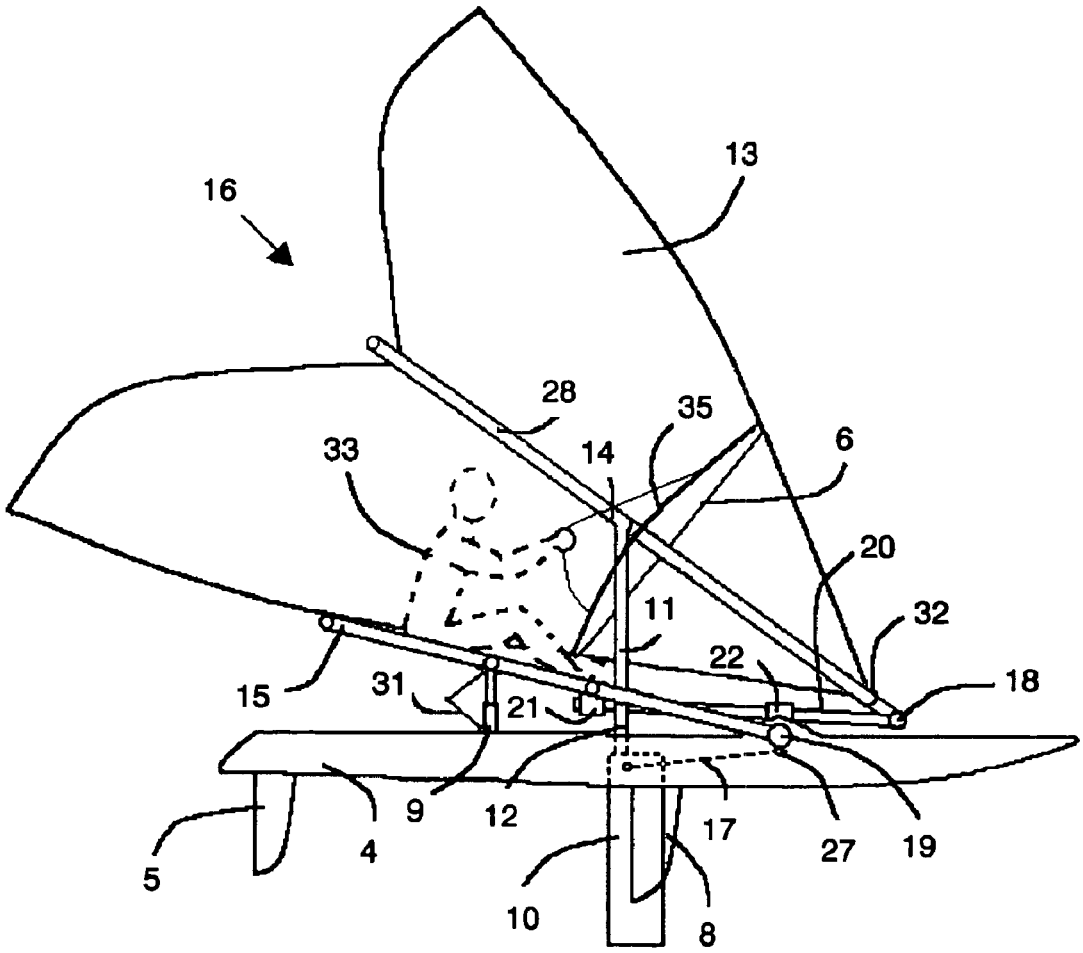
FIG. 5 is a side view of a preferred embodiment of the catamaran with an unstayed swinging rig mechanism that uses a centering keel to offset movement of the mast and wings due to changes in wind direction. The rig stabilizing hinged struts and shock absorbers are also illustrated. A sailor is shown in a sitting position.

FIG. 5 is a side view of a preferred embodiment of the windsurfing catamaran 16 with the wind direction to starboard. It illustrates an unstayed, free swinging, shock dampened rig mechanism that uses a counter rotating centering keel 10 to offset movement of the catamaran wings 13 due to changes in wind direction. The stabilizing struts 31 and shock absorbers 9 are also illustrated in this figure. The rig mechanism is comprised of a mast 11 that is attached at one end to the centering keel 10 and at the other end to pivot point 14 and the center spar 28 that supports the wing 13. The mast 11 is also pivotably attached to mast support bar 20 at mid-rig. Mast support bar 20 is pivotably attached to the deck assembly 15 by pivot points 21 and 22. Rotating mechanism 12 represents the pivot point at which the centering keel 10 and the wing 13 rotate in relation to one another. The mast 11 is pivotably attached at its upper end to the center spar 28 at pivot point 14. The center spar 28 is pivotably attached at its forward end to the mast support bar 20 at elevational pivot point 18 and rotational pivot point 32. Deck assembly 15 is secured to the mast support bar 20 at pivot points 21 and 22, to the hulls 4 at pivot points 19, to struts 31 and shock absorbers 9 aft of hulls 4. Sitting sailor 33 is shown.

By attaching the wing 13 to the center spar 28, pivot point 14, mast 11, deck assembly 15, and centering keel 10 in this manner, they are insulated from the movement of the hulls 4 by the shock absorbers 9 and supported by hinged struts 31 so that the hulls 4 move independently from the wing 13. This allows the wing 13 to respond to changes in the wind with minimal interference from movement of the hulls 4 on the water surface caused by waves. Likewise, conformation of hull 4 motion to the water surface is not interfered with by wind pressure applied to the wing 13. As a result, the pivotable linking of these components of the wind surfing catamaran 16 allows independent motion of the components which in turn contributes to easier independent control of the wing 13 and easier independent control of the hulls 4.

Figure 6:
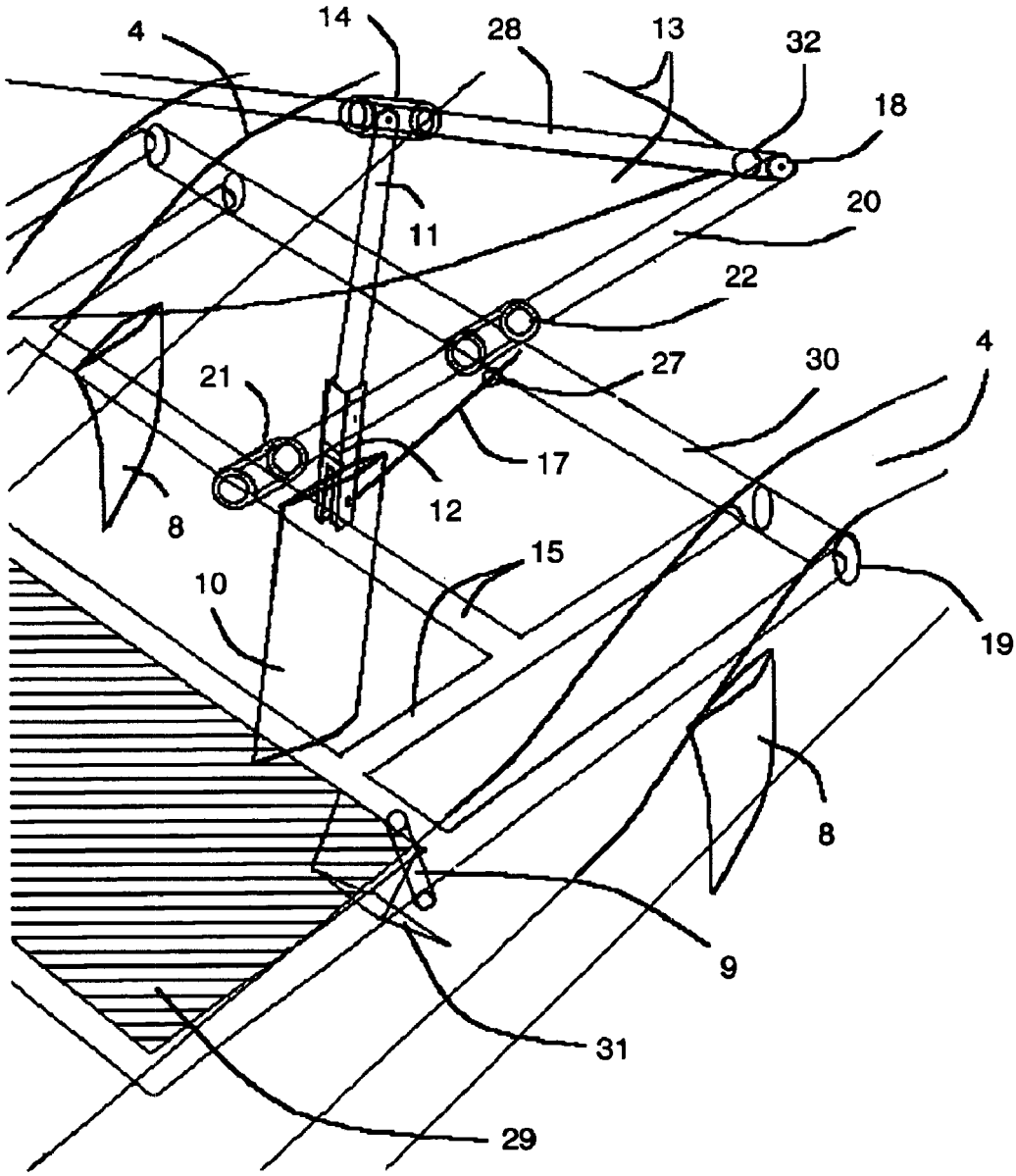
FIG. 6 is a perspective transparent view of a preferred embodiment of the mast and keel that illustrates how they attach to a delta winged sail. The rig stabilizing hinged struts and shock absorbers are also illustrated in this figure.

FIG. 6 is a perspective transparent view of a preferred embodiment of the center spar 28, mast support bar 20, centering keel 10, mast 11, portion of deck assembly 15, deck or trampoline 29 and crossbeam 30. This figure illustrates how the centering keel 10 and the wing 13 are attached and how they are controlled in relation to one another. The keel centering rod 17 and the centering rod guide 27 shown here point the swinging, rotating centering keel 10 toward the center as it moves through the water to guide the wing 13 upright.

The centering keel 10 is able to rotate via rotating mechanism 12 and swing sideways along a portion of the mast support bar 20. As the wind forces the wing 13 in one direction, the mast 11 rotates about the mast support bar 20 which forces the keel 10 in the opposite direction. In addition, as the wind applies pressure to the wing 13, the wind will cause the mast 11 to rotate the mast support bar 20 at mast pivot points 21 and 22. This causes the centering keel 10 to swing sideways while rotating on its axis such that the larger side surface of the centering keel 10 is moved into the oncoming water flow as the catamaran 16 moves through the water guided by dagger-boards 8 and rudders 5. The water flow provides substantial pressure against the centering keel 10 to move it back into position. As a result, when changes in wind direction move the wing 13 out of position, the water flow acts against the centering keel 10 in the opposite direction to push the wing 13 back into position. The centering keel 10 and the supporting structure provide a self-correcting mechanism to stabilize the wing 13 against changes in wind direction.

Those skilled in the art will recognize that due to the greater force exerted by the water against the keel 10, as opposed to the force of wind against the wing 13, the size of the keel 10 can be a fraction of the size of the wing 13 and still have a substantial effect on positioning the wing 13 upright. By rotation of the keel 10 in this manner, the sailor is relieved of the physical burden of trying to maintain the wing 13 upright, allowing the windsurfing catamaran 16 to be operated by sailors of lesser skill.

Figure 7:
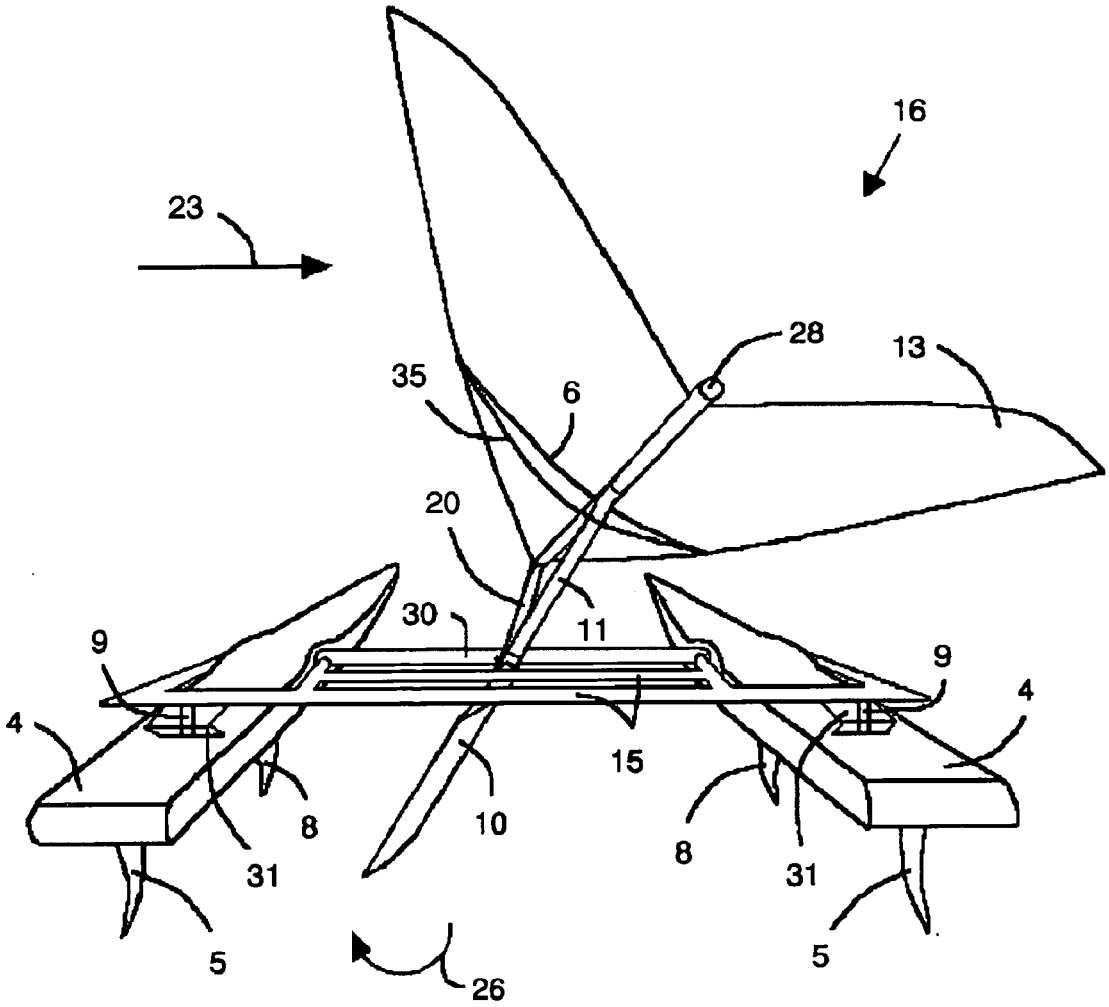
FIG. 7 is a rear perspective view of a preferred embodiment of a catamaran with a delta wing sail attached to the keel by a swinging mast via a central pivot. This figure illustrates the relative movement of the canted sail and the keel when a change in wind direction is encountered.

FIG. 7 is a rear perspective view of a preferred embodiment of a catamaran 16 that illustrates relative movement of the wing 13 and the keel 10 when a change in wind direction is encountered. As can be seen, the wing 13 rotates, in this case to the right, under wind pressure 23. Likewise, the keel 10 is simultaneously rotated in a clockwise direction 26 to place the side surface of the keel 10 in the direct path of the oncoming water. The force from the oncoming water counteracts the force of the wind 23 to push the keel 10 back to the central position. In turn, the keel 10 applies pressure via the mast 11 to move the wing 13 back into position.

Figure 8:
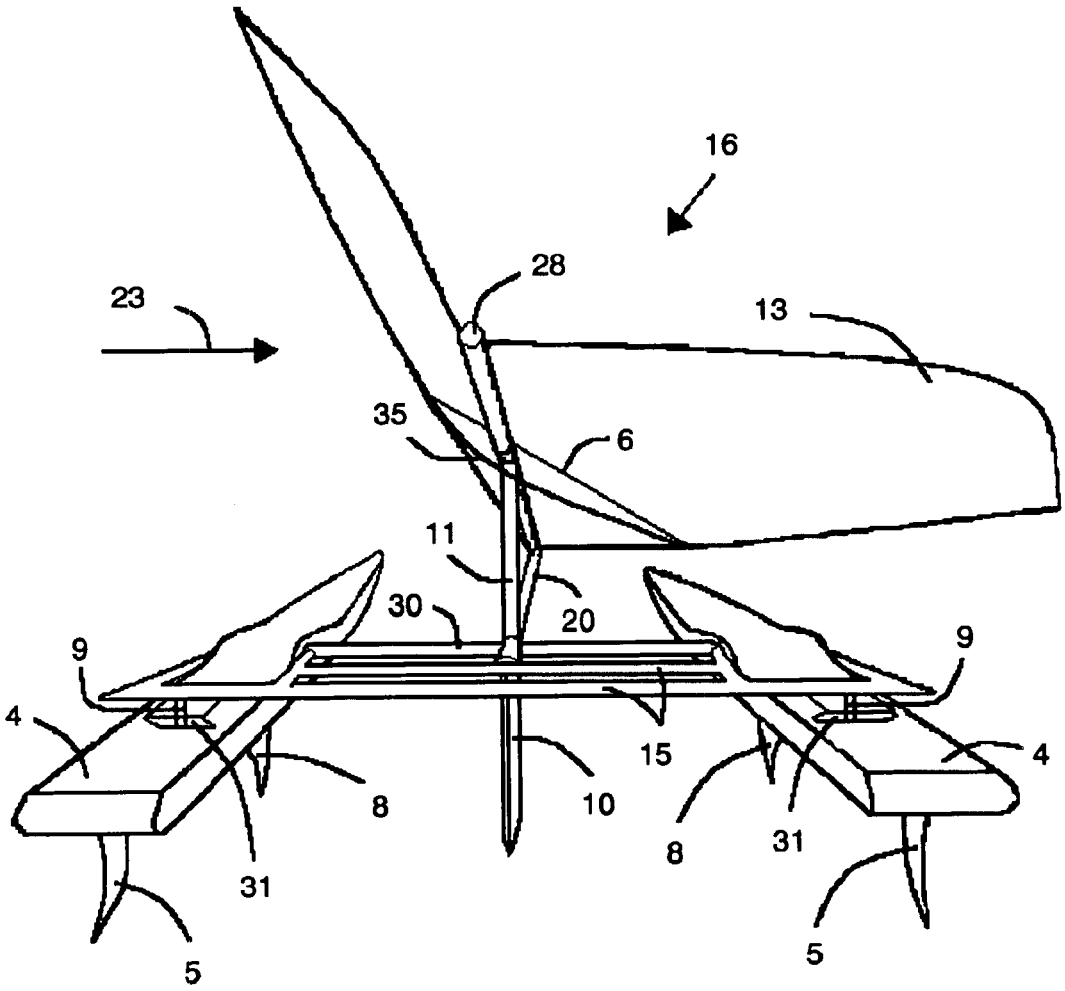
FIG. 8 is a rear perspective view of the preferred embodiment of a catamaran that illustrates the relative movement of the canted delta wing sail and keel when the water flow forces the keel back toward a central stable position.

FIG. 8 is a rear perspective view of a preferred embodiment of the windsurfing catamaran 16 with wind direction to port. It shows an unstayed wing 13 sail and a counteracting centering keel 10. This figure illustrates the windsurfing catamaran 16 sailing in the dynamically stable position. In this position, the keel 10 is oriented in the direction of travel and presents minimum resistance to the water flowing around it. In addition, the lower water drag results in greater effectiveness of driving force produced by wind against the wing 13. The canted wing 13 sail is shown in relation to the direction of the wind pressure 23.

Figure 9:
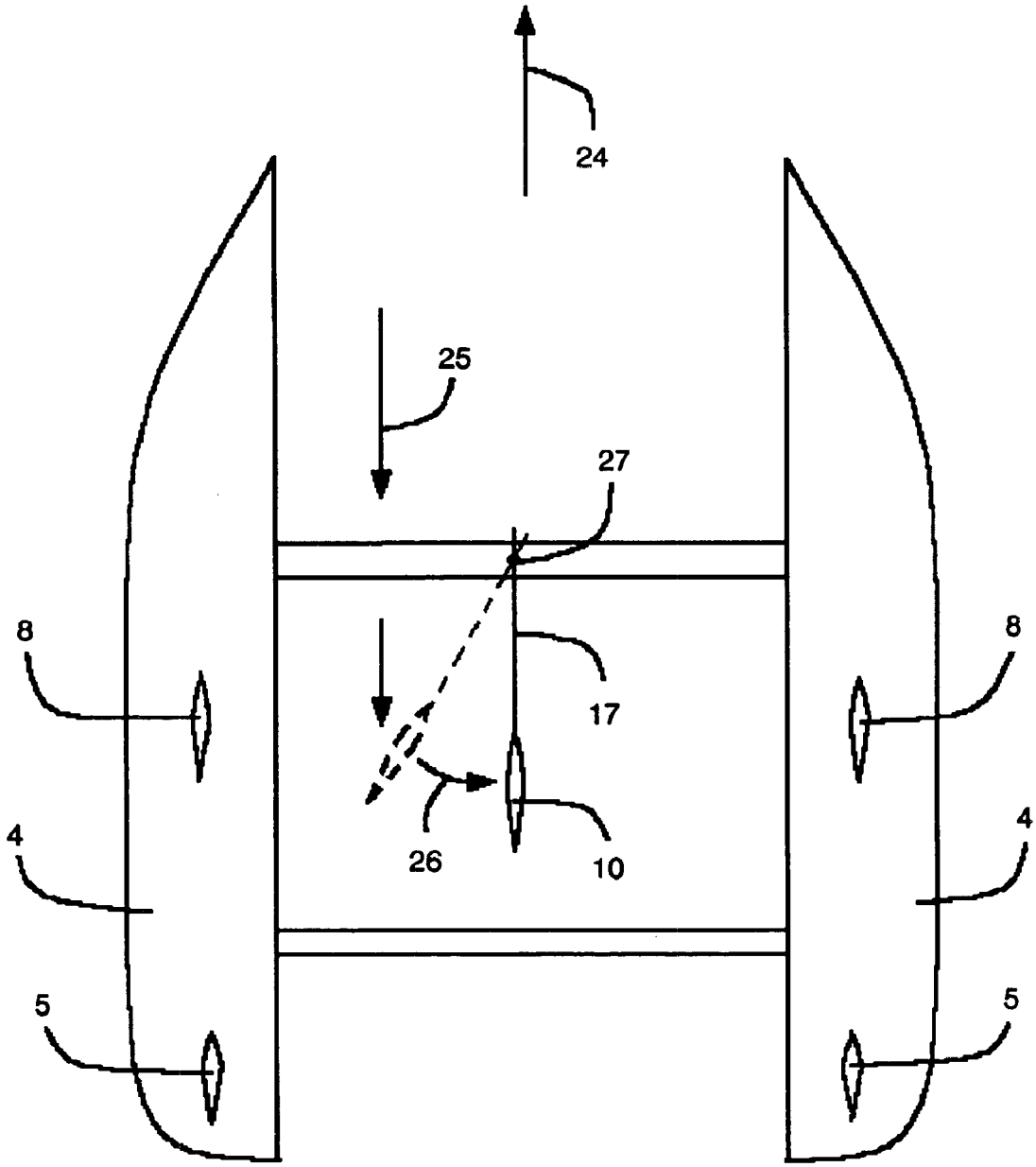
FIG. 9 is a bottom view of a preferred embodiment of a catamaran that illustrates the effect of water flow in forcing the keel towards a central stable position.

FIG. 9 is a partial bottom view of a preferred embodiment of a catamaran 16 that illustrates the effect of water flow 25 in forcing the keel 10 towards a central stable position. In this figure, the catamaran 16 is moving forward in direction 24. Water flow in relation to the catamaran 16 is in direction 25. When the wing 13 and mast 11 are moved out of position by wind pressure, the centering rod 17 attached at one end to the keel 10 and at the other end to the swiveling centering rod guide 27 act to rotate the keel 10 into the path 25 of the water. When the water impacts the side of the keel 10, the keel 10 is rotated in direction 26 back towards a central position that exposes it to minimal water pressure.

Figure 10:
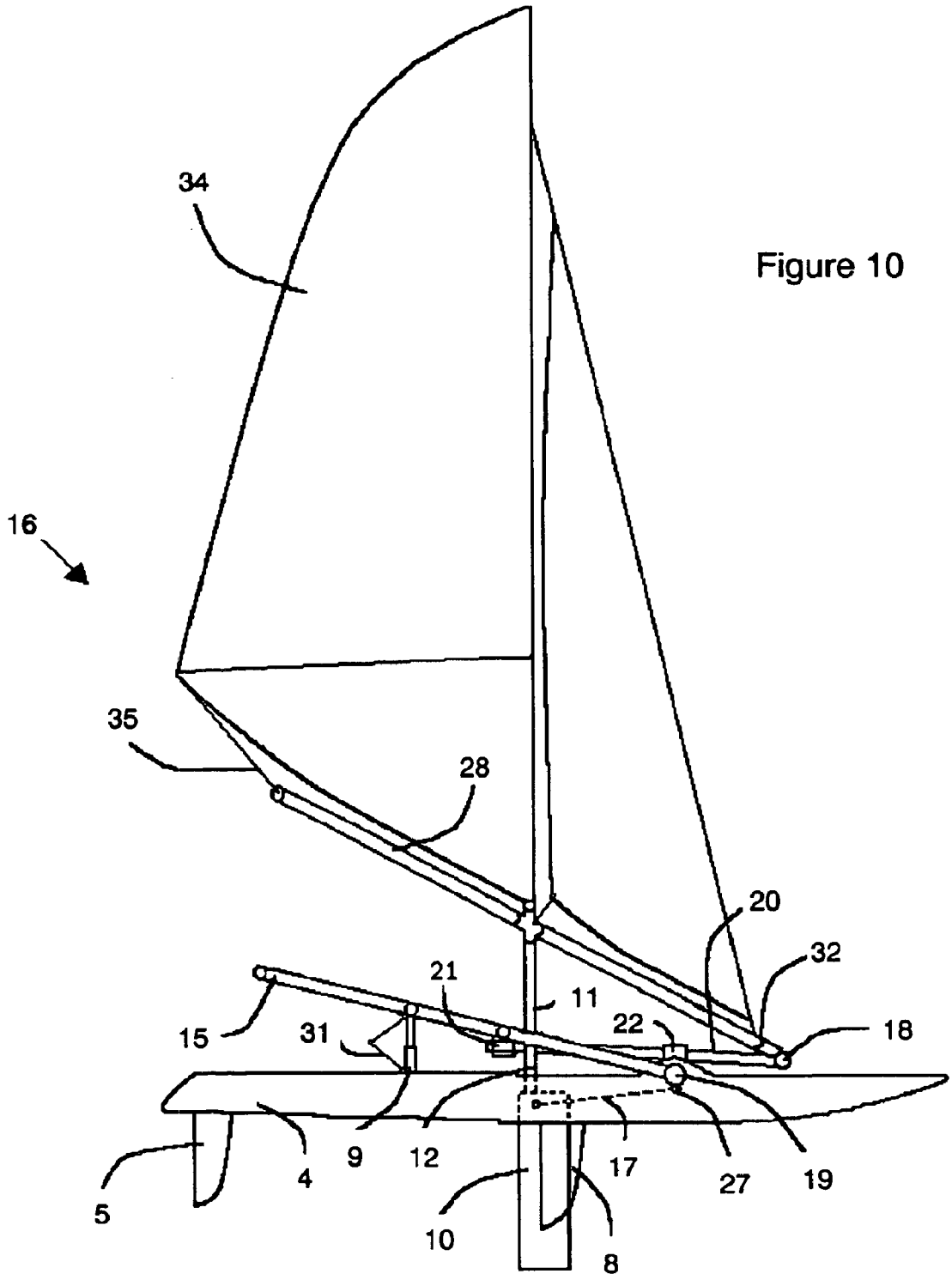
FIG. 10 is a side view of a preferred embodiment of a catamaran that illustrates the use of an alternate single sail.

FIG. 10 is a side view of a preferred embodiment of the windsurfing catamaran 16 with an unstayed, free swinging, shock dampened rig mechanism that uses a counter rotating centering keel 10 to offset movement of the catamaran wing 34 due to changes in wind direction. In this figure, the windsurfing catamaran 16 is illustrated with an alternate single sail 34.

As can be seen from the foregoing, the invention provides several advantages. In particular, it provides an automatic position correction to mast 11 and wing 13 or sail 34 resulting in greater efficiency and control of the catamaran 16. Further, the hinged struts 31 and shock absorbers 9 support and protect the integrity of the rig and allow the hulls 4 to move independently of one another and of the wing 13 or sail 34. The dynamic stability of the catamaran 16 is enhanced as a result, by preventing individual components from interfering with one another during operation. In addition, speed of the catamaran 16 is enhanced by automatically maintaining the mast 11 and the wing 13 or sail 34 in the correct orientation without interference from wave induced hull 4 movement and with a minimum amount of effort to the sailor.

While the invention has been described with respect to a preferred embodiment thereof, it will be understood by those skilled in the art that various changes in detail may be made therein without departing from the spirit, scope, and teaching of the invention. For example, the material used to construct the shock absorbers may be anything suitable for their purpose. The sail may be a delta wing, standard single sail, Aerorig, kite, or other prior art sail. The keel may be ballasted or the mast temporarily stayed to keep the rig upright when the catamaran is at rest. The size and shape of this windsurfing catamaran and its components can vary. It can incorporate a cabin or cabins and one or more auxiliary engine(s). The pivot mechanisms can be anything suitable to accomplish their purpose. Accordingly, the invention herein disclosed is to be limited only as specified in the following claims.

I claim:

1. A windsurfing catamaran, further comprising:

a central deck assembly;

at least a first and second hull, the first hull and the second hull substantially parallel to one another and separated by the central deck assembly;

an unstayed mast assembly attached to the central deck assembly between the two hulls; and a central keel attached to the unstayed mast assembly and extending in a downward direction from the unstayed mast assembly, the central keel cooperatively connected to the unstayed mast assembly such that it moves with movement of the unstayed mast assembly;

one or more wings attached to the unstayed mast assembly, the wings secured to the unstayed mast assembly such that they provide thrust under pressure of wind to move the catamaran; and the unstayed mast assembly further having means to tilt independently of the hulls in response to pressure from the wings, such that the hulls position is substantially independent of changes in orientation of the mast assembly;

counter rotation means, the counter rotation means movably attaching the central keel to the unstayed mast assembly such that when the unstayed mast assembly is rotated under wind pressure away from a central position toward one side of the catamaran, the central keel is rotated toward the other side of the catamaran such that the flat side surface of the central keel is moved into the path of oncoming water flow, the oncoming water flow applies pressure against the central keel to move it back toward the central position;

a central spar attached substantially along its longitudinal length to the wings, and attached at one end to the distal end of a mast support bar via an elevational pivot point, the central spar further having a rotational pivot point to allow the spar to rotate in response to shifts in wind pressure applied by the wings;

the mast support bar further being pivotably attached to the central deck assembly such that rotation of its distal end in one direction will cause its proximal end to rotate in the same direction;

a mast, the mast slidably attached at its upper end to the center spar such that the central spar can rotate under wind pressure applied via the wings, the mast attached at its lower end to the central keel, and the mast further having a mast aperture through which the mast support bar is slidably inserted and retained;

whereby the unstayed mast assembly and the keel move in cooperation with one another, and the hulls are not pulled from the water when the wings are moved by wind pressure, and pressure from oncoming water flow is applied to the central keel to move it back toward a central position, and the central keel applies pressure to the unstayed mast assembly to simultaneously move it back to the central position, and the central spar can slidably rotate in relation to the mast and the mast can slidably and rotationally move in a forward and backward direction along a portion of the mast support bar.

2. A windsurfing catamaran, as in claim 1, wherein:

the central deck assembly is pivotably attached on its starboard side to the first hull and pivotably attached on its port side to the second hull;

a first shock absorbing means attached between the first hull and the starboard side of the central deck assembly, and a second shock absorbing means attached between the second hull and the port side of the central deck assembly;

the first shock absorbing means providing force against the first hull such that pressure is applied to the first hull to maintain its best position in response to changes in the water surface caused by waves to stabilize the wing, mast, keel and central deck assembly, and the second shock absorbing means providing force against the second hull such that pressure as applied to the second hull to maintain its best position in response to changes in the water surface caused by waves to stabilize the wing, mast, keel and central deck assembly;

whereby the first and second shock absorbing means provide independent control over the position of the first and second hulls, respectively, to stabilize the wing, mast, keel and central deck assembly.

3. A windsurfing catamaran, further comprising:

a central deck assembly;

at least a first and second hull, the first hull and the second hull substantially parallel to one another and separated by the central deck assembly;

the central deck assembly pivotably attached on its starboard side to the first hull and pivotably attached on its port side to the second hull;

an unstayed mast assembly attached to the central deck assembly between the two hulls; and a central keel attached to the unstayed mast assembly and extending in a downward direction from the unstayed mast assembly, the central keel cooperatively connected to the unstayed mast assembly such that it moves with movement of the unstayed mast assembly;

a first shock absorbing means attached between the first hull and the starboard side of the central deck assembly, and a second shock absorbing means attached between the second hull and the port side of the central deck assembly; and the first shock absorbing means providing force against the first hull such that pressure is applied to the first hull to maintain its best position in response to changes in the water surface caused by waves to stabilize the wing, mast, keel and central deck assembly, and the second shock absorbing means providing force against the second hull such that pressure is applied to the second hull to maintain its best position in response to changes in the water surface caused by waves to stabilize the wing, mast, keel and central deck assembly;

counter rotation means, the counter rotation means movably attaching the central keel to the unstayed mast assembly such that when the unstayed mast assembly is rotated under wind pressure away from a central position toward one side of the catamaran, the central keel is rotated toward the other side of the catamaran such that the flat side surface of the central keel is moved into the path of oncoming water flow, the oncoming water flow applies pressure against the central keel to move it back toward the central position;

a central spar attached substantially along its longitudinal length to the wings, and attached at one end to the distal end of a mast support bar via an elevational pivot point, the central spar further having a rotational pivot point to allow the spar to rotate in response to shifts in wind pressure applied by the wings;

the mast support bar further being pivotably attached to the central deck assembly such that rotation of its distal end in one direction will cause its proximal end to rotate in the same direction;

a mast, the mast slidably attached at its upper end to the central spar such that the central spar can rotate under wind pressure applied via the wings, the mast attached at its lower end to the central keel, and the mast further having a mast aperture through which the mast support bar is slidably inserted and retained;

whereby the first and second shock absorbing means provide independent control over the position of the first and second hulls, respectively, to stabilize the wing, mast, keel and central deck assembly, and the hulls are not pulled from the water when the wings are moved by wind pressure, and pressure from oncoming water flow is applied to the central keel to move it back toward a central position, and the central keel applies pressure to the unstayed mast assembly to simultaneously move it back to the central position, and the central spar can slidably rotate in relation to the mast and the mast can slidably and rotationally move in a forward and backward direction along a portion of the mast support bar.

4. A windsurfing catamaran, as in claim 3, further comprising:

the first shock absorbing means includes a shock absorber and a stabilizer strut; and the second shock absorbing means includes a shock absorber and a stabilizer strut.

5. A method of stabilizing a windsurfing catamaran, including the steps of:

attaching an unstayed mast assembly to a windsurfing catamaran having at least two hulls such that changes in wind direction and/or wind speed will move the mast assembly away from a central position in relation to the catamaran hulls;

using a central keel which is attached to the mast assembly such that when the mast assembly is moved away from the central position, the central keel is rotated such that it is moved into water flow under the catamaran and pressure from the water flow pushes the keel and the central mast assembly back toward the central position;

controlling movement of the central keel in relation to the unstayed mast assembly by attaching the central keel to the mast such that the mast is slidably and rotationally attached to a mast support bar to provide lateral pivoting, and attaching the mast support bar to a central deck assembly such that the mast and keel move rotationally about a central pivot point such that when the unstayed mast assembly moves to one side of the catamaran, the keel moves to the opposite side of the catamaran; and the central keel, when rotated from the central position under, wind pressure applied to the unstayed mast assembly, is moved under pressure from water flowing under the windsurfing catamaran back toward the central position;

pivotably attaching a central deck assembly to opposing hulls on the windsurfing catamaran such that each of the hulls can pivotably move in relation to the central deck;

attaching the wings to a central spar substantially along the longitudinal length of the central spar such that movement of the wings will be directly translated to the central spar;

rotatably attaching the central spar to a pivot point such that the wings can rotate in relation to the pivot point;

attaching a mast support bar to the pivot point and further attaching the mast support bar to a rotational pivot point to allow the mast support bar and the central spar to rotate in relation to the hulls in response to shifts in wind pressure applied by the wings;

whereby movement of the mast assembly away from a stable central position by wind pressure is at least partially counter balanced by water pressure applied against the movable central keel which moves in the opposite direction of the central mast assembly, and the central keel is rotated in relation to the central mast assembly such that when the central mast assembly is moved away from the direction of movement of the catamaran, water pressure under the catamaran forces the keel and the central mast assembly back towards a central position, and wind changes will cause the central spar to slidably rotate in relation to the hulls and rotationally move the keel into the flow of oncoming water.

6. A method, as in claim 5, including the additional step of:

using shock absorbing means to attach a point on each of the hulls to a corresponding point on the central deck assembly such that, when the hulls move in relation to the deck assembly, the shock absorbing means will move the hulls independently to the best position in relation to water flowing under the windsurfing catamaran to stabilize the central deck assembly;

whereby the position of each hull in regard to the surface of the water and deck assembly is independently maintained by the shock absorbing means.

7. A method, as in claim 6, including the additional step of:

using a combination of shock absorbers and struts to form the shock absorbing means.

* * * * *